US006503023B2

(12) United States Patent
Huang et al.

(10) Patent No.: US 6,503,023 B2
(45) Date of Patent: Jan. 7, 2003

(54) TEMPORARY FLOATATION STABILIZATION DEVICE AND METHOD

(75) Inventors: Edward Huang, Houston, TX (US); Bruce Zurbuchen, Katy, TX (US); Vince Giorgi, Houston, TX (US); Shaji Samuel, Houston, TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

(21) Appl. No.: 09/853,255

(22) Filed: May 11, 2001

(65) Prior Publication Data

US 2002/0025229 A1 Feb. 28, 2002

Related U.S. Application Data

(60) Provisional application No. 60/203,628, filed on May 12, 2000.

(51) Int. Cl.[7] ..... B63B 35/44; E02D 23/02

(52) U.S. Cl. ..... 405/206; 405/205; 405/223.1; 405/224; 114/264; 114/266

(58) Field of Search ..... 405/203, 204, 405/205–209, 223.1, 198, 199, 224; 114/259, 260, 264–267

(56) References Cited

U.S. PATENT DOCUMENTS

| | | | | | |
|---|---|---|---|---|---|
| 2,525,955 | A | * | 10/1950 | Scott | 405/205 |
| 2,938,352 | A | * | 5/1960 | Knapp et al. | 405/207 |
| 3,054,367 | A | * | 9/1962 | Alcorn et al. | 405/209 |
| 3,064,437 | A | * | 11/1962 | Knapp | 405/206 |
| 3,347,052 | A | * | 10/1967 | Steitle et al. | 405/205 |
| 3,610,193 | A | * | 10/1971 | Lacy | 114/265 |
| 3,633,369 | A | * | 1/1972 | Lawrence | 405/205 |
| 3,686,886 | A | | 8/1972 | Georgii | 61/46.5 |
| 3,780,685 | A | * | 12/1973 | Horton | 114/265 |
| 3,811,681 | A | | 5/1974 | Sprouse et al. | 273/139 |
| 3,823,564 | A | | 7/1974 | Crout et al. | 61/46.5 |
| 3,837,309 | A | * | 9/1974 | Biewer | 114/265 |
| 3,859,804 | A | | 1/1975 | Koehler et al. | 61/46.5 |
| 3,919,957 | A | * | 11/1975 | Ray et al. | 114/265 |
| 4,062,313 | A | | 12/1977 | Stram | 114/265 |
| 4,112,697 | A | | 9/1978 | Chow | 405/209 |
| 4,270,877 | A | * | 6/1981 | Post | 405/198 |
| 4,385,578 | A | | 5/1983 | Grace | 114/77 A |
| 4,456,402 | A | * | 6/1984 | Boon | 405/206 X |
| 4,511,287 | A | | 4/1985 | Horton | 405/204 |
| 4,547,095 | A | | 10/1985 | Macchi et al. | 405/206 |
| 4,648,751 | A | | 3/1987 | Coleman | 405/209 |
| 4,662,302 | A | * | 5/1987 | Molnes | 114/265 |
| 4,768,456 | A | | 9/1988 | Jones et al. | 114/266 |
| 4,809,636 | A | | 3/1989 | Robishaw et al. | 114/267 |
| 4,811,681 | A | | 3/1989 | Robishaw et al. | 114/267 |
| 4,874,269 | A | | 10/1989 | Dysarz | 405/209 |
| 4,913,591 | A | | 4/1990 | Steele | 405/196 |
| 5,111,764 | A | * | 5/1992 | D'Ettorre | 114/259 |
| 5,224,962 | A | | 7/1993 | Karal et al. | 405/204 |
| 5,403,124 | A | | 4/1995 | Kocaman et al. | 405/209 |
| 5,525,011 | A | | 6/1996 | Huang | 405/223.1 |

(List continued on next page.)

FOREIGN PATENT DOCUMENTS

| | | | | |
|---|---|---|---|---|
| EP | 97069 | * | 12/1983 | 405/206 |

OTHER PUBLICATIONS

Unknown(Figure 6.8.1)–Temporary Buoyancy Augmentation (undated).

*Primary Examiner*—Jong-Suk (James) Lee
(74) *Attorney, Agent, or Firm*—Robert W. Strozier; Alan H. Gordon

(57) ABSTRACT

A temporary stability module and method for marine structures during construction, transportation and installation is taught. The device and method permit the structure, including platforms, deck and equipment to be constructed in an upright position, towed to an ocean installation site, and installed by ballasting the structure or temporary stability module and subsequent removal of the module.

14 Claims, 11 Drawing Sheets

U.S. PATENT DOCUMENTS 5,551,802 A 9/1996 Wybro ..... 405/223.1
5,707,178 A * 1/1998 Srinivasan ..... 405/223.1
5,791,819 A * 8/1998 Christiansen ..... 405/224
5,906,457 A * 5/1999 Choate et al. ..... 405/198
5,924,822 A 7/1999 Finn et al ..... 405/209
6,099,207 A * 8/2000 Bennett ..... 405/199
6,132,143 A * 10/2000 Hovinga et al. ..... 405/206
6,209,474 B1 * 4/2001 Foss et al. ..... 114/259
6,276,875 B1 * 8/2001 Gunnar et al. ..... 405/203

* cited by examiner

TEMPORARY FLOATATION STABILIZATION DEVICE AND METHOD

RELATED APPLICATIONS

This application claims provisional priority to U.S. Provisional Application Ser. No. 60/203,628 filed May 12, 2000, incorporated herein by reference.

BACKGROUND OF THE INVENTION

1. Field of the Invention

The present invention relates to an apparatus for providing temporary stability and floatation to marine or water borne structures ("structures").

More particularly, the invention relates to: (1) a removable apparatus that can be temporarily attached to a structure such as a tension leg platform during the construction, transportation, installation and/or removal of the structure, where the device increases the stability of the structure by increasing its area at the water line; (2) structures having the apparatus(es) or modules attached thereto; and (3) method for using the modules during the construction, transportation, installation and/or removal of the structure.

2. Description of the Related Art

It is widely known and long established that significant and valuable natural resources are located on or beneath the ocean floor or other large bodies of water. This environment creates numerous obstacles or challenges to the exploration, mining or other collection of these resources.

Hydrocarbon liquids and gases trapped below the ocean floor are one of the most common and best known resources that are collected or mined. This mining and collection process has resulted in the construction of large offshore drilling, production, and utility platforms. Variations of platform design and construction have evolved. The earliest platforms were mounted on tall structures attached to the ocean floor. As the exploration of hydrocarbon fuels has progressed into deeper waters or more hostile environments, other platform designs have evolved, e.g., spar, single column floater (SCF) platform structures, and tension leg platform structures.

The cost and difficulty in constructing these structures are significantly diminished when the major portion of construction and assembly of the structure, the attached platform, ancillary equipment, and facilities, is accomplished at or near a shoreline fabrication site. In contrast, construction and assembly at or near the final ocean installation site, is often far removed from the necessary supply base and subject to inclement weather conditions.

Many common types of offshore platforms cannot be fabricated in their entirety at or near shore due to a variety of limitations. A spar platform typically has a large draft, which requires fairly deep water, i.e., greater than approximately 150 meters in its final vertical orientation. The spar platform is, therefore, generally transported on its side without associated equipment or ancillary facilities to the installation site. Offshore construction is required after the platform is upended to its vertical orientation to complete the facility. The cost of offshore construction is substantially greater than construction at an onshore facility. Alternate, devices or methods require the structure to be tilted along its vertical axis to control the structure's stability during installation.

Tension leg platforms (TLPs) can and have been fabricated in their entirety at or near shore and towed as a complete platform to the installation site. However, the efficiency of the platform is compromised because the structure must be designed to be satisfactorily stable at a much shallower draft than the design installed draft. Adequate stability requires larger columns or wider column spacing than would be required for the operation of the structure after installation. Both features, i.e., construction of larger columns or placement of columns at wider intervals, add significant costs to the structure.

Recent advancements in tension leg platforms include single column and extended base varieties. A complete single column tension leg platform, including the platform, deck, equipment and related facilities cannot be constructed at or near shore, because the structure is not stable about its vertical axis until after tendon installation is complete. If the structure is constructed on its side at a shore fabrication site, the ancillary deck, equipment and facilities cannot be constructed until the structure is righted, tendons attached and installation completed. Moreover, these alternate designs for tension leg platform are more efficient when designed and constructed to provide stability only after tendons attachment.

Many devices and techniques have been described in the prior art for transporting structures to an offshore installation site. Many have related to the placement of the structure on its side and floating it to the site. The structure can then be then placed in the final upright position by various techniques such as controlled flooding of the structure or removal of floatation devices. Other devices or techniques have utilized the tipping of the structure during the installation process in order to facilitate stability during installation. Examples of such prior art are found in U.S. Pat. Nos. 3,811,681, 3,823,564, 3,859,804, 3,868,886, 4,062,313, 4,112,697, 4,385,578, 4,648,751, 4,768,456, 4,809,636, 4,811,681, 4,874,269, 4,913,591, 5,224,962, 5,403,124,5, 524,011, and 5,924,822, incorporated herein by reference. However, these devices and/or techniques do not permit the structure, including but not limited to the ancillary platform, deck, equipment and other facilities to be constructed in its final installation orientation, transported to the installation site and installed and secured without tipping the structure or permanently incorporating additional physical elements into the structure that permit such construction, transportation and installation.

Thus there is a need in the art for a device and method that allows the structure to be constructed, transported, installed and later removed in a substantially upright orientation.

SUMMARY OF THE INVENTION

Modules

The present invention provides an apparatus or module adapted to increase stability and optionally floatation of offshore structures, such as tension leg platforms (TLPs), where the module is removable so that its can be temporarily attached to the structure during structure construction, transportation, installation and/or removal. The present invention provides an apparatus or module adapted to increase stability and optionally floatation of offshore structures, such as TLPs, where the module is removable so that it can be temporarily attached to the structure during structure construction, transportation, installation and/or removal and the modules can be hollow, solid, rigid, semirigid, and/or flexible, and can be constructed to be ballasted or deballasted.

Offshore Structures with Modules Attached

The present invention also provides an offshore structure including a module to increase structure stability and optionally floatation to maintain the structure in a substantially upright orientation during structure construction, transportation, installation and/or removal, where the module is removable so that it can be temporarily attached to the structure and at least a portion of the module extends above a waterline (above a surface of a body of water in which the structure is installed).

The present invention also provides an offshore structure including a plurality of removable modules temporarily attached to and disposed at different locations on the structure, where the modules are adapted to increase structure stability and optionally floatation and at least a portion of each module extends above a waterline.

The present invention also provides an offshore structure including a plurality of removable modules attached to and symmetrically disposed about a central vertical axis of the structure, where the modules are adapted to increase structure stability and optionally floatation and at least a portion of each module extends above a waterline.

Although offshore structures such as TLPs generally having buoyant and ballast (floodable) compartments, the inclusion of ballasting compartments adds considerable expense to manufacture and upkeep of the structures because the floodable compartments must be resistant to corrosion and must have valving so that water and/or air can be pumped into or out of the compartments. The modules of the present invention can actually be used to eliminate the need for ballast compartments on the structure itself. Thus, the temporary modules can include all the equipment needed to change the draft of the structure including increasing the draft of the structure (lower the structure in the water) to permit or facilitate tendon attachment to a lower portion of the structure and all tensioning of the structure after tendon attachment.

Methods

Attaching

The present invention also provides a method for increasing the stability of an offshore structure including the steps of attaching one or more modules of this invention to the structure so that at least a portion of each module extends above a water line, where the modules increase a structural stability of the structure.

The present invention also provides a method for increasing the stability of an offshore structure including the steps of attaching a number of modules of this invention to the structure so that at least a portion of each module extends above a water line, where the number of modules is sufficient to maintain the structure in a substantially upright orientation.

Attaching and Removing

The present invention also provides a method for increasing the stability of an offshore structure including the steps of attaching one or more modules of this invention to the structure so that at least a portion of each module extends above a water line, where the modules increase a structural stability of the structure and removing the modules from the structure.

The present invention also provides a method for increasing the stability of an offshore structure including the steps of attaching a number of modules of this invention to the structure so that at least a portion of each module extends above a water line, where the number of modules is sufficient to maintain the structure in a substantially upright orientation and removing the modules from the structure.

Attaching, Changing

The present invention also provides a method for increasing the stability of an offshore structure including the steps of attaching one or more modules of this invention to the structure so that at least a portion of each module extends above a water line and changing a ballast state of at least one of the modules to change the stability of the structure and/or to change a draft of the structure, while maintaining the structure in a substantially upright orientation.

The present invention also provides a method for increasing the stability of an offshore structure including the steps of attaching a number of modules of this invention to the structure so that at least a portion of each module extends above a water line, where the number of modules is sufficient to maintain the structure in a substantially upright orientation and changing a ballast state of at least one of the modules to change the stability of the structure and/or to change a draft of the structure, while maintaining the structure in a substantially upright orientation.

Attaching, Changing, Removing

The present invention also provides a method for increasing the stability of an offshore structure including the steps of attaching one or more modules of this invention to the structure so that at least a portion of each module extends above a water line, changing a ballast state of at least one of the modules to change the stability of the structure and/or to change a draft of the structure, while maintaining the structure in a substantially upright orientation and removing the modules from the structure.

The present invention also provides a method for increasing the stability of an offshore structure including the steps of attaching a number of modules of this invention to the structure so that at least a portion of each module extends above a water line, where the number of modules is sufficient to maintain the structure in a substantially upright orientation, changing a ballast state of at least one of the modules to change the stability of the structure and/or to change a draft of the structure, while maintaining the structure in a substantially upright orientation and removing the modules from the structure.

Attaching, Transporting, Changing, Installing and Removing

The present invention also provides a method for increasing the stability of an offshore structure including the steps of attaching one or more modules of this invention to the structure so that at least a portion of each module extends above a water line, transporting the structure with attached modules from a first site to a second site, changing a ballast state of at least one of the modules to change a draft of the structure, while maintaining the structure in a substantially upright orientation so that a bottom portion of the structure is submerged to a sufficient depth to permit attachment of anchoring tendons, attaching a plurality of tendons to the bottom portion of the structure, deballasting the modules to remove water from an interior of each modules and removing the modules from the structure.

The present invention also provides a method for increasing the stability of an offshore structure including the steps of attaching a number of modules of this invention to the structure so that at least a portion of each module extends above a water line, where the number of modules is sufficient to maintain the structure in a substantially upright orientation, transporting the structure with attached modules from a first site to a second site, changing a ballast state of at least one of the modules to change a draft of the structure, while maintaining the structure in a substantially upright orientation so that a bottom portion of the structure is submerged to a sufficient depth to permit attachment of anchoring tendons, attaching a plurality of tendons to the bottom portion of the structure, deballasting the modules to remove water from an interior of each modules and removing the modules from the structure.

These last two methods can also include step of changing the ballast of one or more of the modules to increase, maintain or decrease structure stability and/or draft during the transporting or tendon attaching steps.

Other variations, changes or modification of the invention will be recognized by individuals skilled in the art that do not depart from the scope and spirit of the invention described and claimed herein.

DESCRIPTION OF THE DRAWINGS

The invention can be better understood with reference to the following detailed description together with the appended illustrative drawings in which like elements are numbered the same.

Figure 1A:
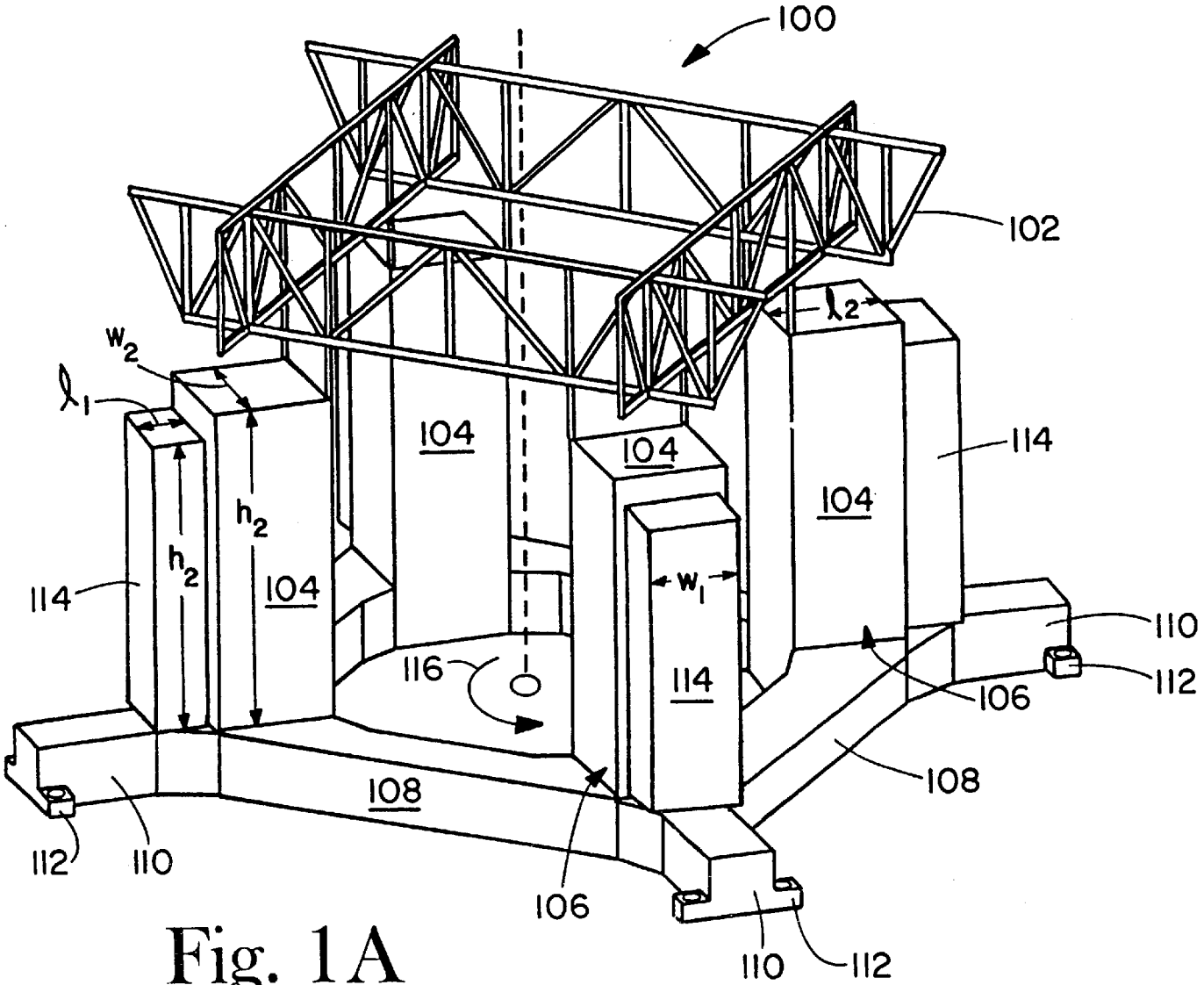
FIG. 1A depicts a perspective view of a four-column, extended base tension leg platform (TLP) with a preferred embodiment of temporary stability modules (TSMs) attached to the columns and extension for additional stability during construction, transportation, installation and/or removal.

The above general description and the following detailed description are merely illustrative of the generic invention, and additional modes, advantages and particulars of this invention will be readily suggested to those skilled in the art without departing from the spirit and scope of the invention.

DETAILED DESCRIPTION OF THE INVENTION

The present invention provides a method and device for increasing or enhancing the economical, efficient and safe construction, transportation, installation and removal of structures and ancillary facilities such as platform deck, equipment and housing. The invention teaches the use of temporary stability apparatus or module (TSM) attached to a structure hull during (i) construction of the structure and the construction of the platform, deck and installation of ancillary equipment and facilities on or above the deck at one or several convenient on-shore or near shore fabrication sites, (ii) transportation of the structure by conventional methods such as ocean towing to the installation site, and (iii) during the installation of the platform, including the securing of the platform at the site by conventional means. Conventional means include, but are not limited to, tendons, conventional catenary, taut-line moorings or the like. The TSM permits the structure to be continuously maintained in the intended stable upright vertical position about the vertical axis during construction of the structure, installation of equipment, towing to the ocean site and installation. The TSM also permits the structure to be maintained upright during the removal of the structure from the ocean site. The TSM can be removed and later reattached to the structure. The TSM provides an economical and safe method to modify the water plane area of the structure to facilitate efficient, stable and continuously upright construction, transportation and installation of the complete structure.

The TSMs of this invention can be constructed in any desired shape and of a variety of materials. The TSMs or portions thereof of this invention can be rigid, semi-rigid or flexible. The TSMs can include floodable compartments for ballasting and/or buoyant compartments for buoyancy. Of course, the floodable compartments will have adjustable ballast and buoyancy depending of the degree of flooding. The TSM can be attached to any offshore structure including, without limitation, main platforms, ancillary platforms, decks, equipments and other facilities. The TSMs can be used to continuously control and maintain the structure in an upright position during construction, transportation, installation and/or removal by increasing the area moment of inertia at the water plane and/or moving the center of gravity toward the base of the structure, which will or is attached to the tendons or other mooring systems.

The TSMs of the present invention, unlike the prior art devices, permit the structure, including, without limitation, the main platform, the ancillary platform, deck, equipment and other facilities, to be constructed in its final upright orientation or configuration, transported to the installation site in its upright position and installed and secured without tipping the structure or permanently incorporating additional physical elements into the structure. Most current TLPs are unstable when the deck, equipment and/or other facilities are attached and would assume an upside down stable orientation in the water, which is not desirable. Once the TLP is moored by tendons or the like, then the decking and other facilities can be constructed on the stabilized TLP. The TSMs of the present invention are designed to provide temporary righting stability so that the upright orientation is preferred over the upside down orientation. Once the TLP with or without other facilities is stable in its upright orientation, the TLP can be constructed, transported, installed, moved, removed or the like without concern for the structure capsizing.

A TSM can be constructed in many alternate forms. Typically, the TSM is constructed using traditional, lowcost, metal fabrication methods and is generally built as a substantially hollow, watertight container of steel, aluminum or similar metal or alloy or mixtures or combinations thereof. Alternatively, the TSM can be constructed of a substantially hollow, watertight container of a high impact resistant plastic or a fiber reinforced resin composite or mixtures or combinations thereof. The TSM can also be constructed out of combination of metals, plastics and/or composites. Moreover, the TSMs of this invention can be stiffened or internally reinforced or braced by cross-member or braces or like as is well known in the art. Other materials known in the industry for providing floatation mechanisms may also be used.

Additionally, the TSMs of this invention can include substantially solid shapes comprising a low-density solid or semi-solid material (e.g. foam), or inflatable bags commonly used in offshore salvage operations. These solid TSMs have the advantage of eliminating the possibility of a puncture that could allow ocean water to flood the TSM and thereby destroy its buoyancy. The solid, low-density materials can be placed inside or coated with high impact resistant materials such as metals or resin based composites, to provide protection and durability from the TSM. Because the TSM is a temporary device, which is removed after the platform is installed, less stringent design and material requirements are imposed, which lowers the cost of the device.

In one preferred embodiment of the TSMs of this invention, one or a plurality of TSMs is(are) temporarily attached to or connected to any type of structure in an arrangement to enhance the stability of the structure by increasing a water plane area of the structure. Generally, the arrangement requires that at least a portion of the TSMs extend above the waterline. Increasing a structure surface area at the waterline or water plane causes a proportional increase in the area moment of inertia at the water plane.

Generally, the stability of any floating structure is determined by or related to the relationship of the center of gravity, the center of buoyancy, and the area moment of inertia at the water plane, that is, the surface area and arrangement of all structure components at the water line. The area moment of inertia of the structure can generally be maximized by a symmetrical placement of the TSMs about a central vertical axis of the structure and extending away from a center of the structure. The TSMs are connected to the structure and are of sufficient area and height so that the meta-center of the combined system (marine structure plus TSM) is maintained above the center of gravity at all times. As used herein, meta-center and meta centric height are as commonly used and understood in naval architecture, such as defined in the *Principles of Naval Architecture*, John Comstock, Editor. Further the location of attachment of the TSMs and their size and shape relative to the structure is such that there is adequate stability, i.e., positive Meta centric height as the structure is ballasted and lowered in the water. The TSMs modify the transverse and longitudinal stability such that tilting of the structure about the vertical axis of the structure is minimized. The TSMs also increase the righting moment, which tends to restore the structure to its stable configuration if the structure is disturbed from this configuration such as through the action of waves, wind or the like.

The TSMs can be arranged to provide any desired degree of stability for safe platform transportation, installation and/or removal. During platform installation, the TSMs can be arranged such that the TSMs can be ballasted to change a structure from a tow draft to a deeper installation draft with no tilting of the structure. The TSMs can supply the entire ballast necessary to change the ballast state of the structure or any portion thereof.

In a preferred embodiment of the invention, the TSM can include valving and control devices for controlled flooding or ballasting and deballasting or unballasting, which can facilitate the lowering of the structure during the installation process so that the tendons or other anchoring systems can be attached to the structure. Once the structure has been attached to the anchoring means, the ballast of the TSMs can be changed to permit the structure to assume its final tensioned draft. The TSMs can then be removed by any method set forth herein. When the structure is to be removed, the TSMs can be reattached to the structure via any methods set forth herein. The draft of the structure can be changed by ballasting either the TLP and/or the TSMs, where the TSMs impart stability to the structure during removal of the structure from the installation site.

The ability to partially or fully flood the TSM allows the weight and/or buoyancy of the TSMs to be adjusted in a controlled manner. This can assist the installation of the structure by controlling the location of the center of buoyancy relative to the center of gravity of the structure, while increasing the area moment of inertia to the water plane.

The change in buoyancy of the TSM can most easily be accomplished by releasing air or gas from the TSM and the addition of ocean water as ballast. This can be accomplished by manual adjustment of valves or similar openings or by automated, remotely controlled mechanisms to add water and/or air to change the relative buoyance of weight of the TSMs. The TSMs can also include manual or remote controlled pumps or gas injectors.

The TSM can be attached to the platform by any conventional means common for the industry, including mechanical latches, pins, automatic or remotely operated couplings, manually operated couplings latches or pins, semi-permanent connections such as welding and subsequent cutting, rivets or bolts.

In another embodiment, the structure can be lowered in the water to a deeper draft or raised to a shallower draft by controlled adjustment of the ballast of only the structure with no change in the buoyancy of the TSM.

In another embodiment, the structure can be lowered or raised to a different draft by means of controlling the ballast of the TSM only and without any change in the ballast of the structure. In fact, the structure can have no ballasting comparts or parts with the TSMs supplying all the ballasting to the structure.

In a preferred embodiment of the invention, the ballast of the structure and the TSM can be controlled in a separate or combined manner. Several methods are considered for the removal of the TSM in a controlled manner from the structure after the structure has been secured at the installation site by tendons or other anchoring means and the TSM is no longer required. The methods allow detachment and removal with minimum risk of damage to the structure and danger to the workers.

In one preferred embodiment, controlled flooding of the TSM by whatever means, including the examples described previously, can be accomplished so that the TSM is neutrally buoyant, slightly positive buoyant, or slightly negative buoyant in relation to the structure. In another preferred embodiment of the invention, the buoyancy of the structure can be controlled. In this embodiment, the structure can be ballasted by the addition of water until the structure is negatively buoyant in relation to the TSM.

After or simultaneously with the controlled ballast operations, the TSM can be removed from the structure. This can be accomplished by attaching conventional towing or lifting lines to the TSM and either towing safely away from the structure using an auxiliary vessel, or by lifting with a crane attached to the offshore platform itself or to an auxiliary vessel. Therefore, in another embodiment of the invention, the TSM is attached to the structure by means of hook devices. Upon completion of installation, the TSM may be lowered away from the structure with minimal or no disassembly of hardware or mechanical fasteners.

The TSM can be reused to support multiple platform installations. The TSM can also be used after the platform has supported its useful life at one location, and requires removal. In this case, the TSM is towed to the location either floating or placed on an auxiliary barge, installed on the structure, and deballasted in a controlled manner to provide the stability required for platform removal.

In another preferred attachment means of this invention, a plurality of guides are attached to the structure where the TSMs are to be placed. The TSM is lowered into place using the guides. Once the TSM is in place, slidable locking means can slide into place to prevent the TSM from changing position sufficient slide past the guide height.

TLP Structures with Temporary Stabilization Modules

Referring now to FIG. 1A, a preferred stabilized tension leg platform structure 100 of this invention is illustrated to include a deck 102 designed to support facilities for hydrocarbon drilling or processing (not shown), where the structure 100 includes four vertically extending columns or legs 104 having lower ends 106 and horizontal pontoons 108 interconnecting adjacent legs 104 at their lower ends 106. The structure 100 also includes leg extensions 110 having tension leg attachments 112 designed to attach to an upper end of tendons (not shown) and four TSMs 114. The structure 100 is symmetrically disposed about a central vertical axis 116.

In the structure 100, the TSMs 114 are shown to be substantially rectangular solids having a length $l_1$ smaller than a length $l_2$of the legs 104; a width $w_1$ smaller than a width $w_2$ of the legs 104; and a height $h_1$ smaller than a height $h_2$ of the legs 104. Of course, for square legs 104, $l_2$=$W_2$. Each TSM 114 is also characterized by its width $w_1$ being greater than its length $l_1$ and its height $h_1$ being greater than both its length $l_1$ and its width $w_1$.

Figure 1B:
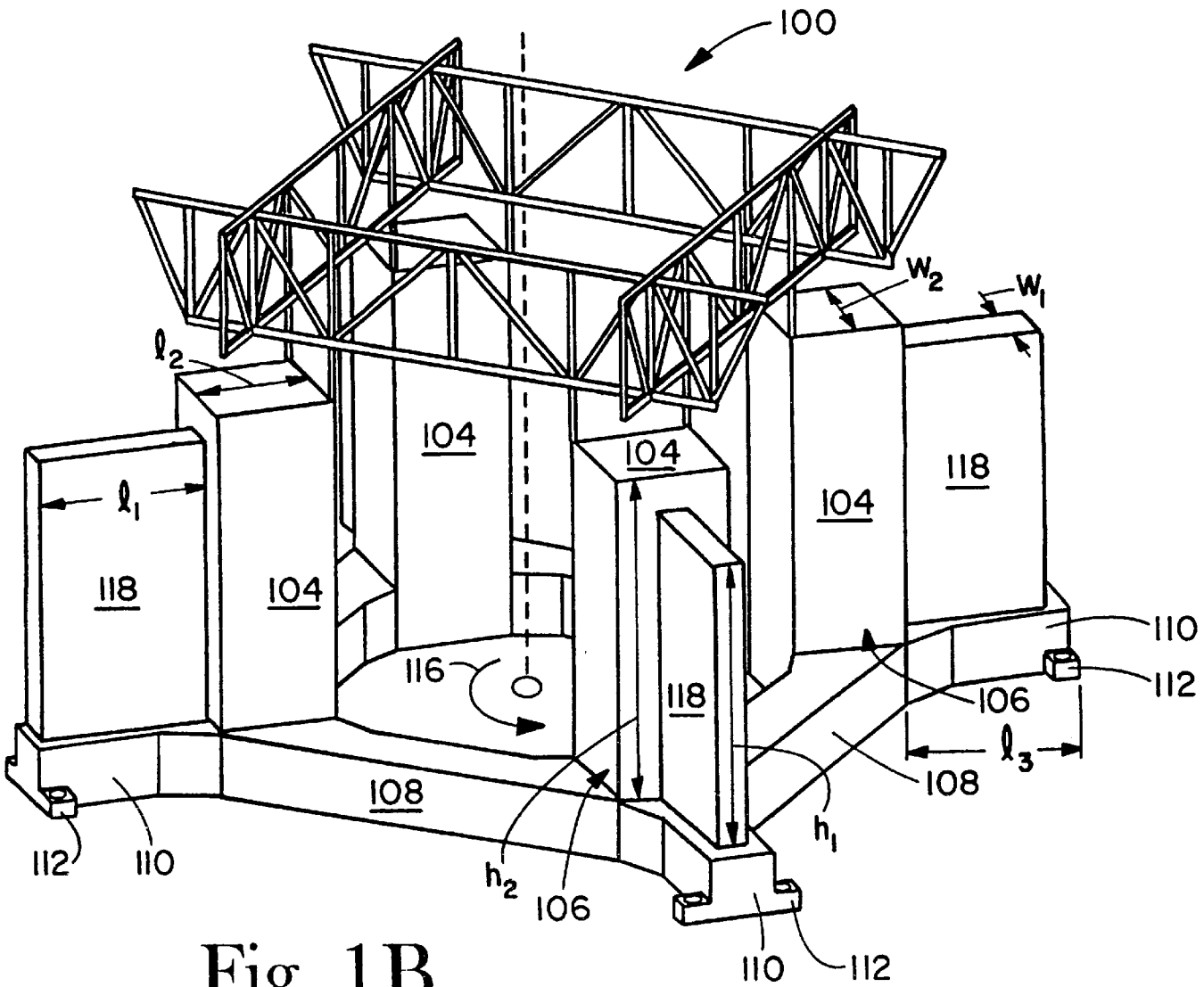
FIG. 1B depicts a perspective view of a four-column, extended base tension leg platform (TLP) with another preferred embodiment of temporary stability modules (TSMs) attached to the columns and extension for additional stability during construction, transportation, installation and/or removal.

Looking at FIG. 1B, the preferred stabilized tension leg platform 100 is shown with another preferred embodiment of the TSMs 118, which are also substantially rectangular solids. However, the dimensions of the TSMs 118 are significantly different from the dimensions of the TSMs 114 of FIG. 1A. While each TSM 118 of FIG. 1B has a width $w_1$ smaller than the width $w_2$ of the legs 104 and a height $h_2$ smaller than the height $h_2$ of the legs 104, the length $l_1$ of the TSM 118 is larger than its width $w_1$ and larger than the length $l_2$ of the legs 104, yet smaller than a length $l_3$ of the extensions 110.

Although two preferred TSMs have been described in FIGS. 1A and B, the TSMs of this invention can be of any shape, size and/or dimension. However, rectangular solid TSMs of this invention generally have widths ranging between about 2 and about 10 meters, lengths ranging from about 2 to about 30 meters and heights ranging from about 10 to about 40 meters. The preferred and particular size of the TSM will depend on the dimensions of the structure for which they are used to enhance stability.

Figure 1C:
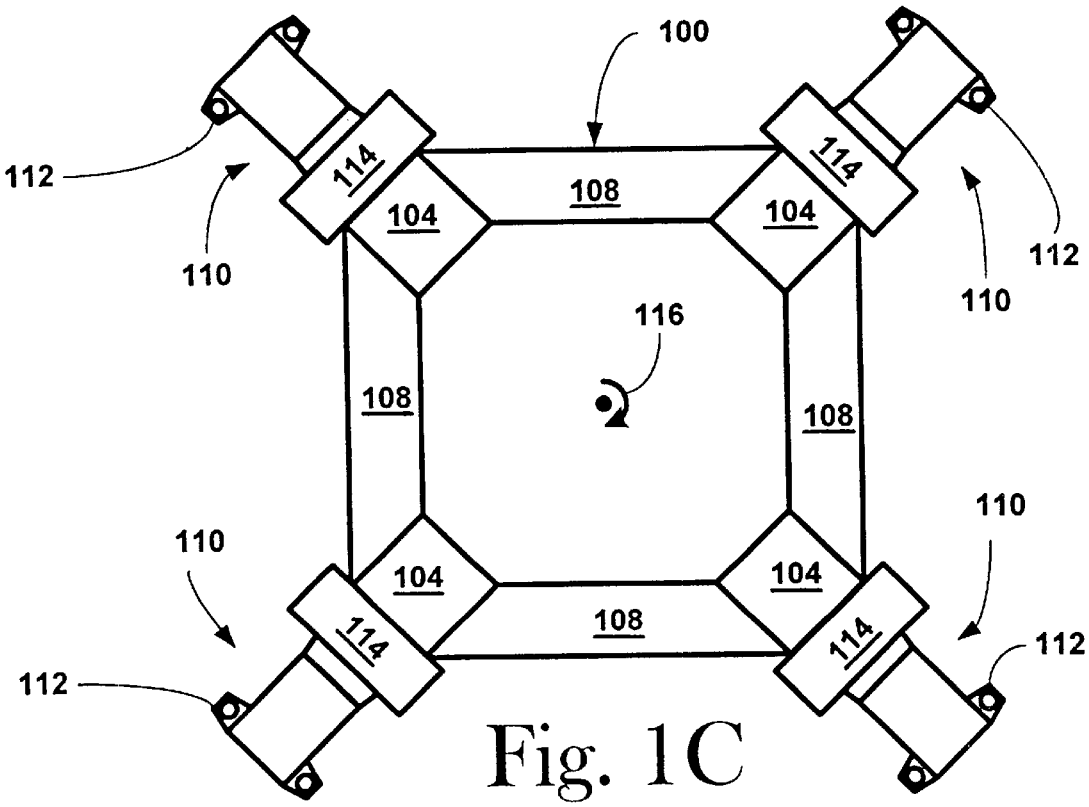
FIG. 1C depicts a top plan view of the structure of FIG. 1A.
Figure 1D:
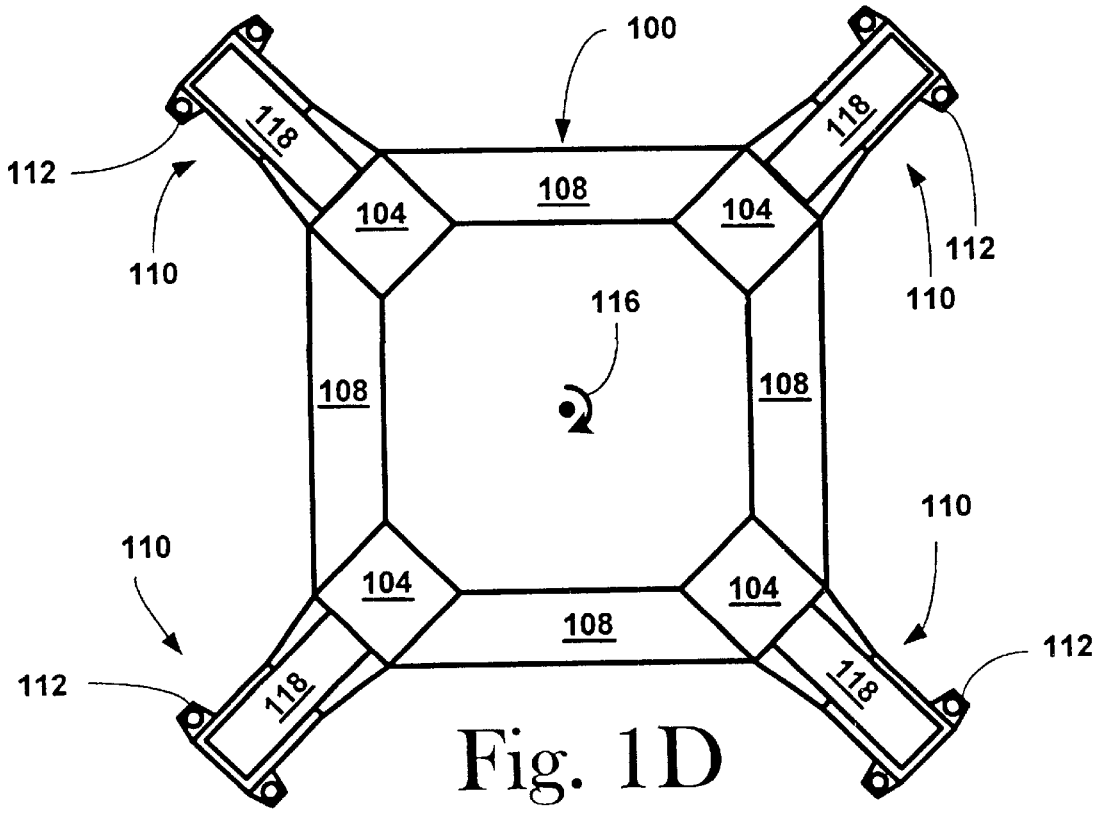
FIG. 1D depicts a top plan view of the structure of FIG. 1B.
Figure 1E:
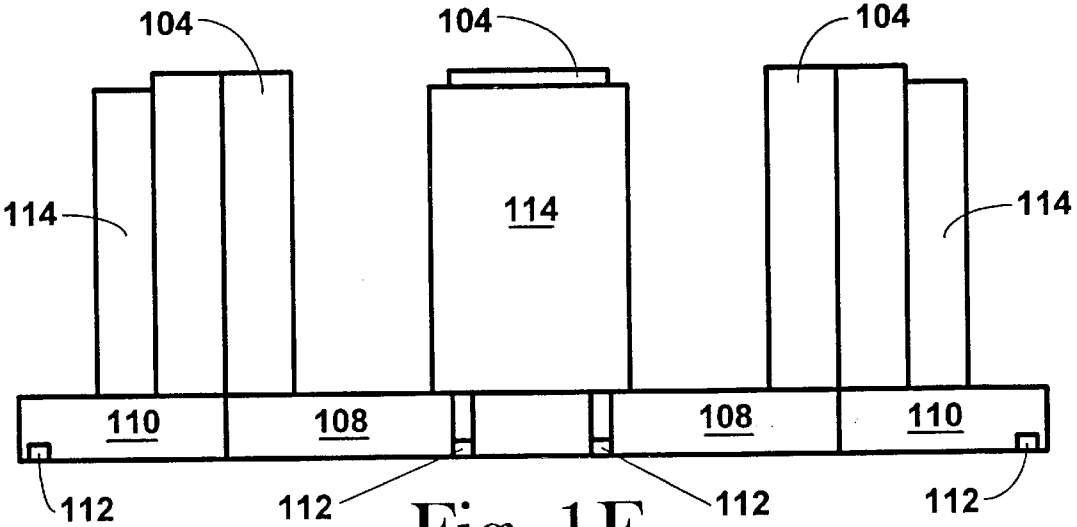
FIG. 1E depicts a side view of the structure of FIG. 1A.
Figure 1F:
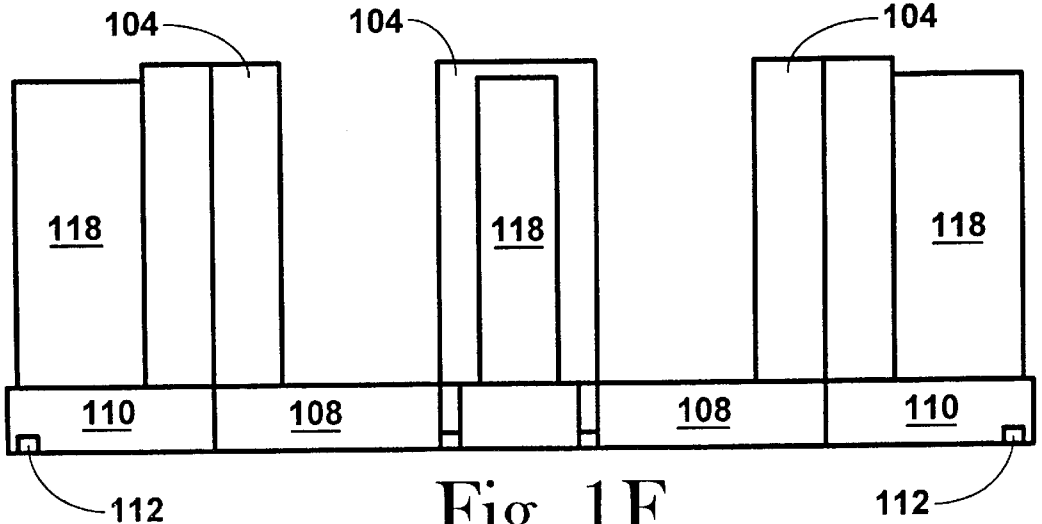
FIG. 1F depicts a side view of the structure of FIG. 1B.

Referring now to FIGS. 1C&D, top views of the stabilized tension leg platform structures of FIGS. 1A&B show the symmetrical placement of four legs 104 and the four associated TSM 114 and 118 relative to the central axis 116 of the structure 100. FIGS. 1/E&F illustrate side views of the stabilized tension leg platform structures of FIGS. 1A&B showing the relationship between the legs 104 their lower ends 106, the pontoon 108 and the TSMs 114 and 118.

FIGS. 1A–F relate to a fairly new tension leg platform referred to as an extended base tension leg platform more details relating to the construction of extended base tension leg platforms can be found in co-pending application Ser. No. 09/609,885, filed Jul. 5, 2000, incorporated herein by reference.

Figure 2:
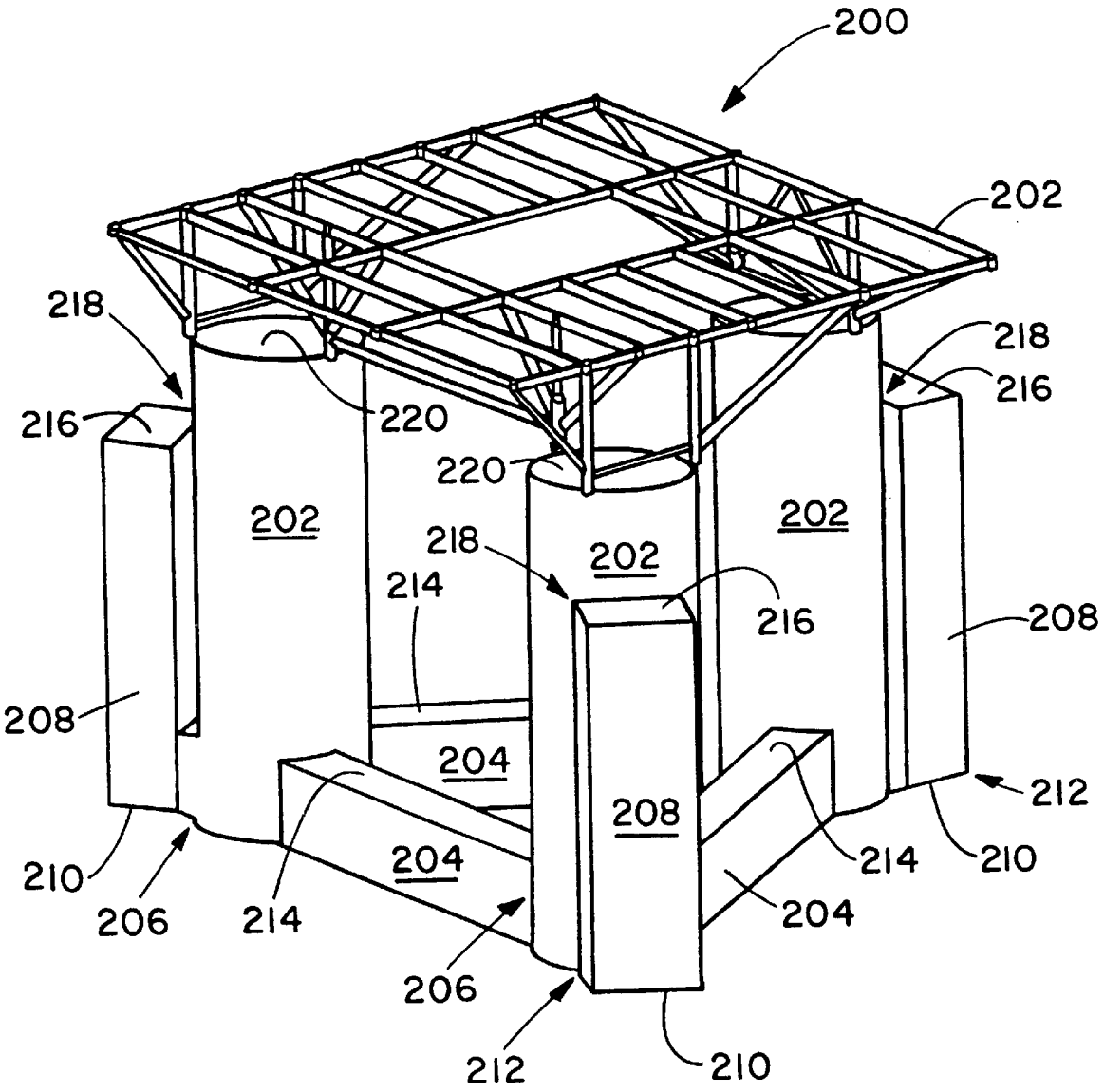
FIG. 2 depicts perspective view of another preferred embodiment of rectangular TSMs of this invention attached to a three round column TLP.

Referring now to FIG. 2, another preferred embodiment of a stabilized tension leg platform structures of the invention generally 200 is shown to include three columns or legs 202 and pontoons 204 interconnecting adjacent legs 202 at each legs lower end 206. The structures 200 also includes a TSM 208 attached to each leg 202. A lower end 210 of each TSM 208 is positioned at a bottom position 212 located between the lower end 206 of the leg 202 to which it is attached and a top surface 214 of the horizontal pontoons 204. An upper end 216 of each TSM 208 is positioned at a top position 218 below an upper end 220 of the leg 202 to which it is attached. The top position 218 should be located so that at least a portion of each TSM 208 will extend above the waterline even when the structure 200 is in its installation draft configuration, which generally represents the deepest draft experienced by the structure 200. As stated previously, the TSM increase the area moment of inertia at the water plane by increasing the area at the water plane and by extending the area out away from the centroid of the structure, which for symmetrical structures is generally located on or near the central vertical axis (not shown) of the structure. Although the TSMs 208 are shown as rectangular solids, the TSMs could be on any shape such as cylindrical, oval cross-sectionally shaped columns, or the like. Additionally, the TSMs can be segmented so that segments can be added to or removed from to change the height, width, and/or length of the TSMs.

SCF Structures with Temporary Stabilization Modules

Figure 3:
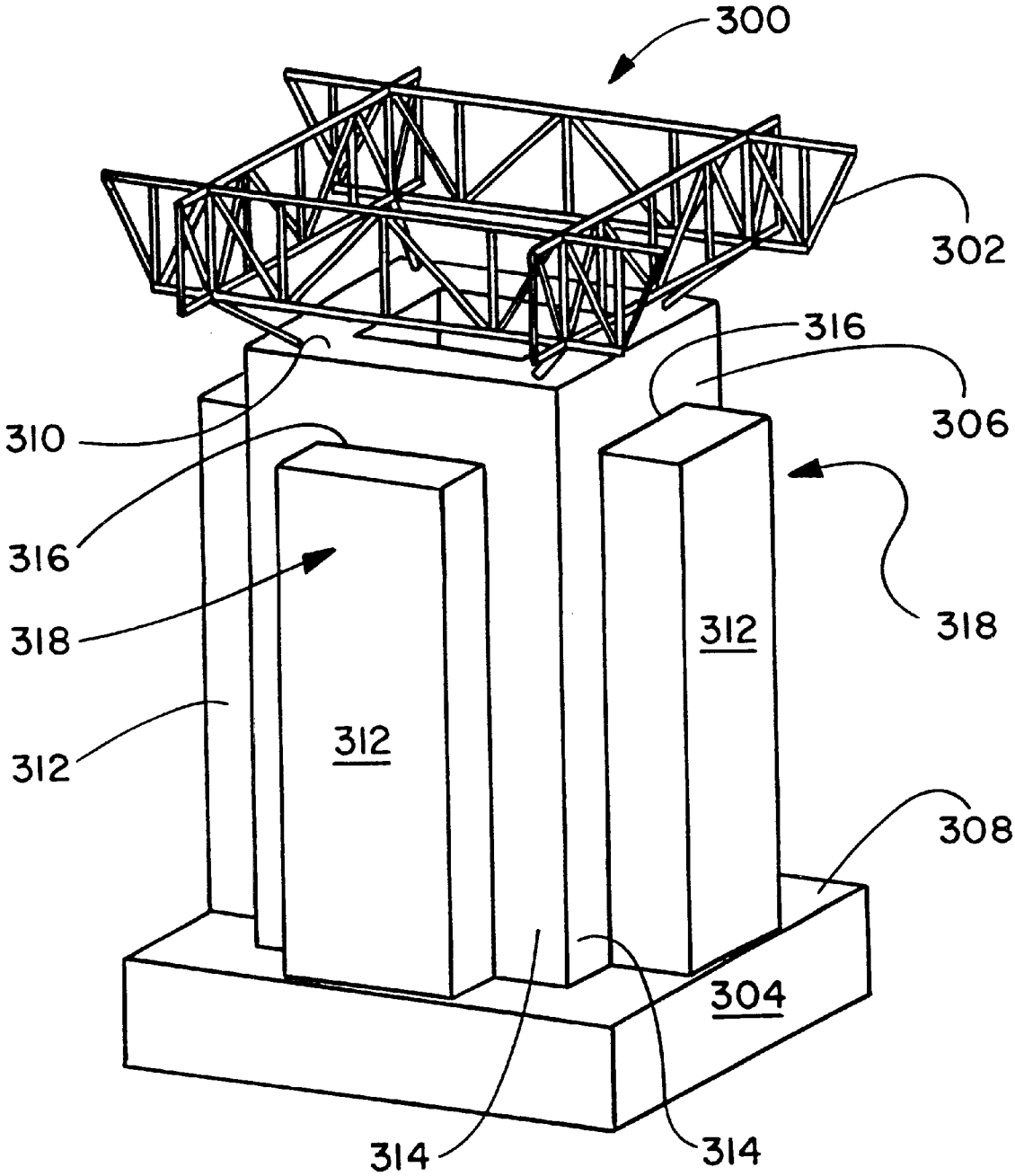
FIG. 3 depicts perspective view of a preferred embodiment of rectangular TSMs of this invention attached to a single column floater (SCF) at four locations about the column.

Referring now to FIG. 3, a preferred embodiment of a stabilized single column floater structure of the invention generally 300 is shown to include a deck 302, a horizontally disposed base rectangular (square) base 304 and a rectangular column 306. The column 306 is affixed to or integral with a top surface 308 of the base 304 and extends upward a height sufficient for a top 310 of the column 306 to extend above the waterline after structure installation to support the deck 302 and associated equipment and/or other facilities (not shown). The structures 300 also includes four TSMs 312 attached to the column 306 at its four sides 314 and extending from the top surface 308 of the base 304 to a position 316 below the top 310 of the column 306, where the position 316 allows at least an upper portion 318 of the TSM 312 to extend above the waterline even when the structure 300 is ballasted to its installation draft. Again the TSMs 312 are substantially rectangular solids, although many other shapes will work as well.

Figure 4:
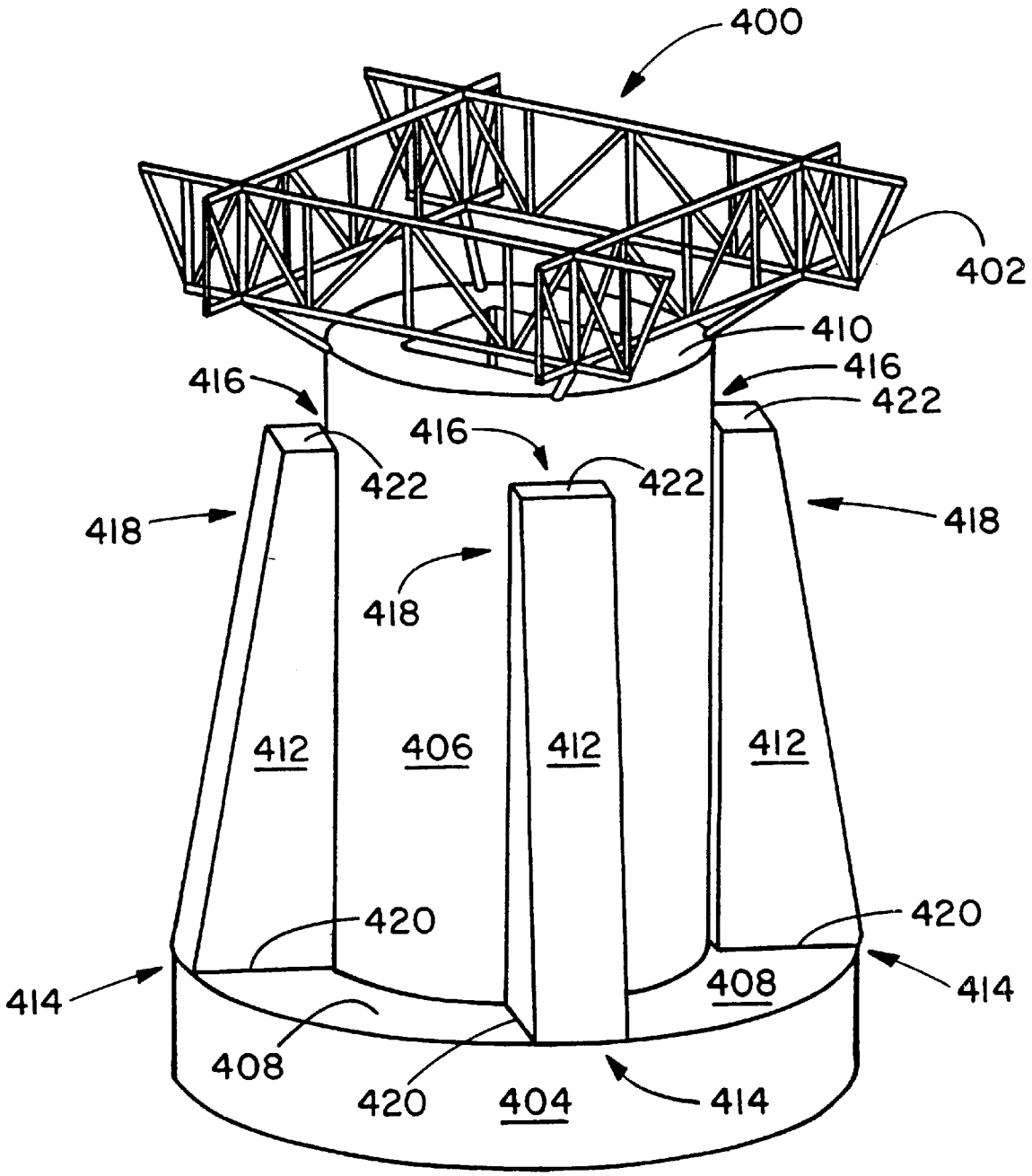
FIG. 4 depicts perspective view of tapered TSMs of this invention attached to a SCF at four locations about the column.

Referring now to FIG. 4, another preferred embodiment of a stabilized single column floater structure of the invention generally 400 is shown to include a deck 402, a horizontally disposed circular (oval) base 404 and a cylindrical or oval shaped column 406. The column 406 is affixed to or integral with a top surface 408 of the base 404 and extends upward a height sufficient for a top 410 of the column 406 to extend above the waterline after structure installation to support the deck 402 and associated equipment and/or other facilities (not shown). The structures 400 also includes four TSMs 412 attached to the column 406 at four equidistant positions 414 around the circular base 404 and extending from the top surface 408 of the base 404 to a position 416 below the top 410 of the column 406, where the position 416 allows at least an upper portion 418 of the TSM 412 to extend above the waterline even when the structure 400 is ballasted to its installation draft. The TSMs 412 of this figure are shown to be trapezoidal solids which have their larger ends 420 resting on the top surface 408 of the base 404 and their smaller ends 422 at the position 416. Although the TSMs 412 are shown oriented with the large end 420 down, the TSMs can be oriented with their large ends 420 up. Moreover, the TSMs 412 can be constructed in many other shapes as well.

TSM Installation and Removal Procedures

Figure 5A:
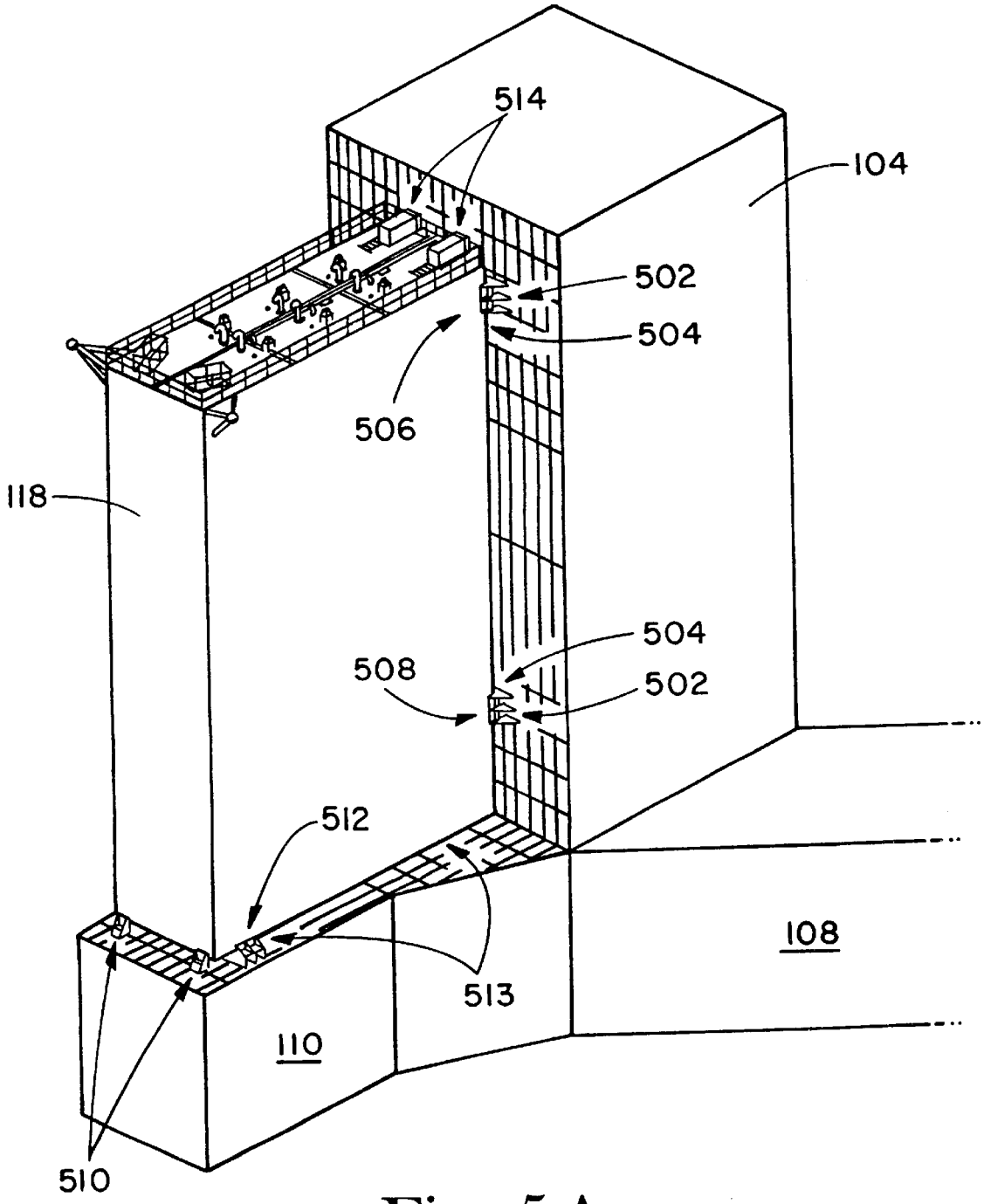
FIG. 5A depicts a perspective view of a preferred embodiment of a TSM securing apparatus of this invention.
Figure 5B:
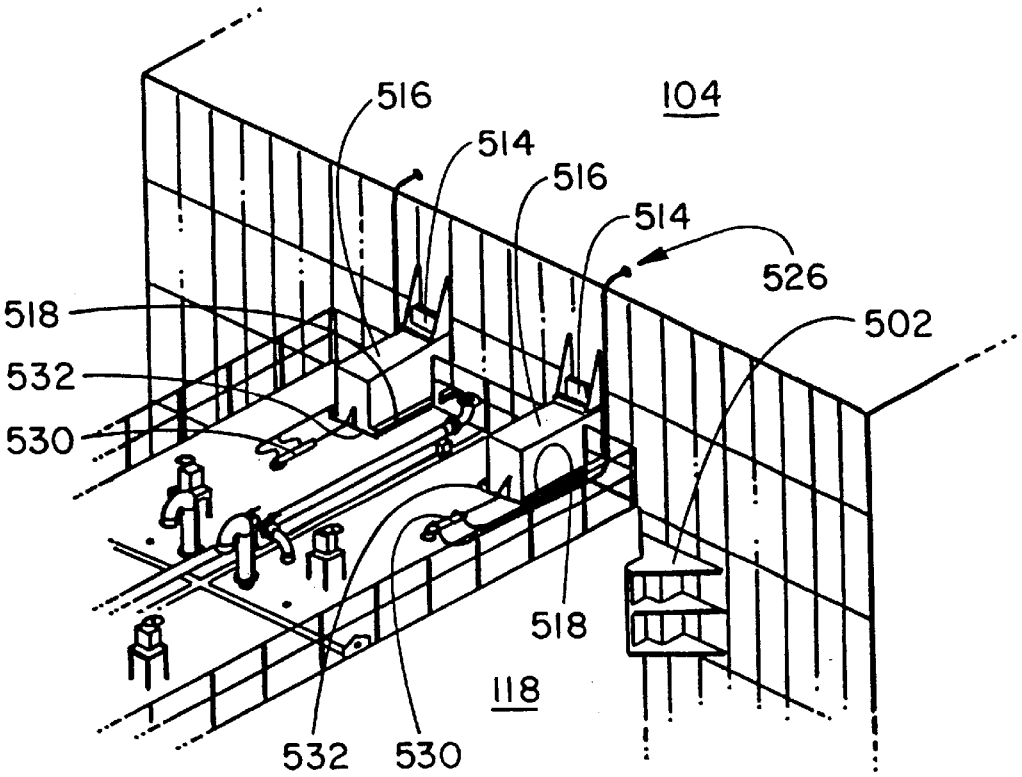
FIG. 5B depicts an expanded perspective view of the locking mechanism of the securing apparatus of FIG. 5A in its locked state.
Figure 5C:
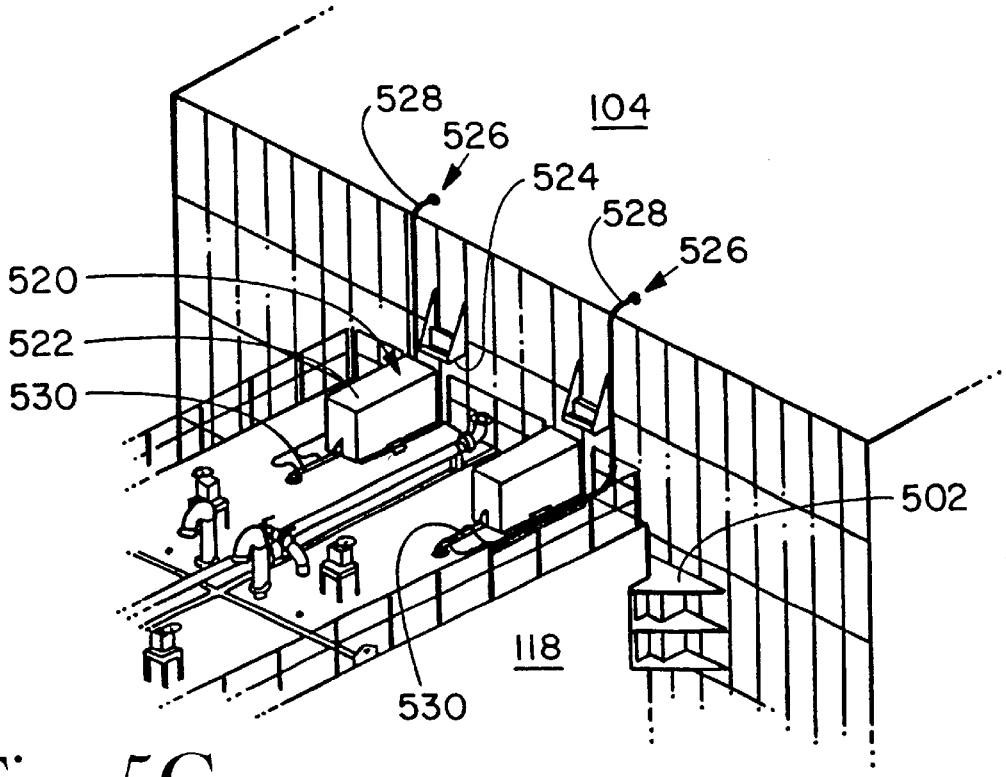
FIG. 5C depicts an expanded perspective view of the locking mechanism of the securing apparatus of FIG. 5A in its unlocked state.

Referring now to FIG. 5A, a preferred embodiment of an TSM attachment and locking system 500 designed to secure TSMs of this invention to a leg or column 104 and an extension 110 of the extended base TLP structure 100 of FIG. 1B is shown to include lateral column shear blocks 502 and associated column pads 504 located on the leg or column 104 at an upper position 506 and a lower position 508. The structure 100 also includes longitudinal extension shear blocks 510 and lateral extension shear blocks 512 affixed to the extension 110 and extension pads 513. The structure 100 also includes locking shear blocks 514 affixed to the column 104 and associated hydraulically activated shear locks 516 and guides 518. The locks 516 are designed to move from a locked position along the guides 518 where a portion 520 of a top surface 522 of the locks 516 engage a lower end 524 of the locking shear blocks 514 as shown in FIG. 5B to a unlocked state where the locks 516 have moved back along the guides 518 and no longer engage the locking shear blocks 514 as shown in FIG. 5C. FIGS. 5B&C also show hydraulic quick disconnects 526, associated hydraulic lines 528 and hydraulic actuators 530. The locking system 500 can also include stops 532 to secure the shear locks 516 in their locked state. Of course, the system can include a fewer number or a greater number of lateral and longitudinal shear blocks and locking mechanisms. The TSMs 118 can be lowered into place using a crane or can be floated into place using tug boats and positioned so that the TSM 118 is against the column pads 504 and laterally confined by the lateral column shear blocks 502. The TSM 118 can then be ballasted until the TSM 118 rests on the extension pads 513 and is longitudinally secured by longitudinal blocks 510. Once in its proper position, the TSM 118 can be locked in place by activating the hydraulic actuators 530 which move the shear locks 516 along their guides 518 into their locked state as shown in FIG. 5B. Reversing the process allows the TSM 118 to be removed.

Figure 6A:
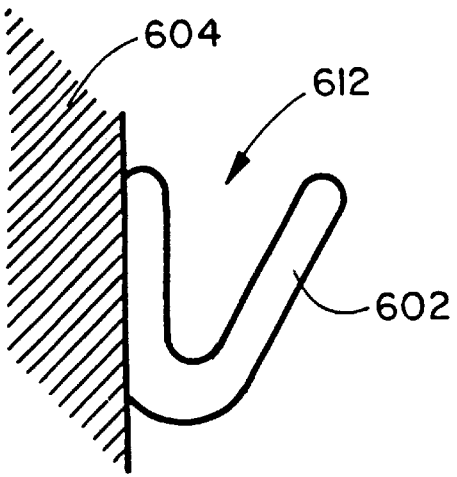
FIGS. 6A–B depict side plan view of another preferred securing apparatus of this invention involving hooks and pegs.
Figure 6B:
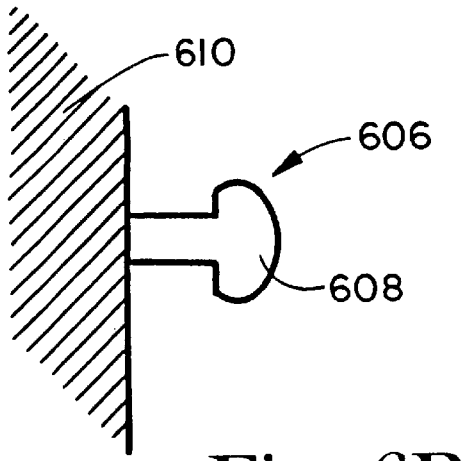
Figure 6C:
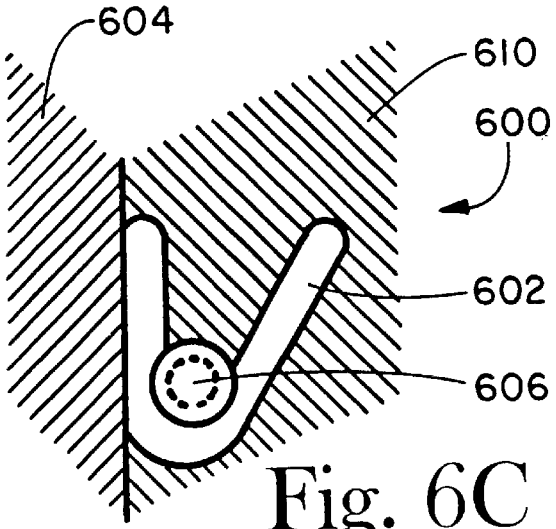
FIGS. 6C–D depict the securing apparatus of FIGS. 6A–B in its locked and unlocked states respectively.
Figure 6D:
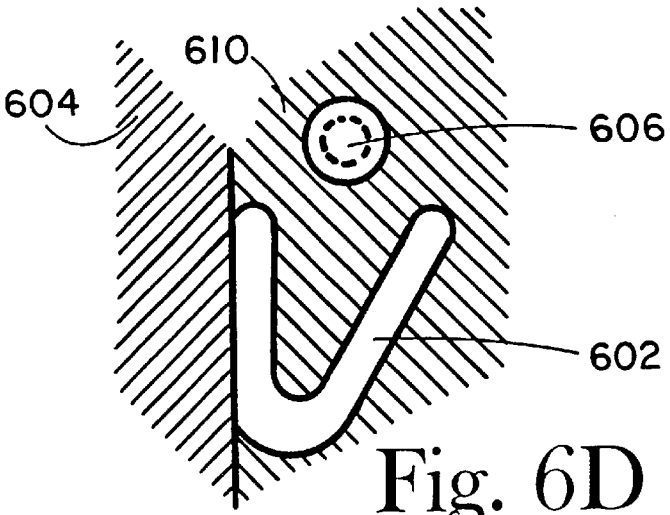

Referring now to FIGS. 6A–D, another locking system 600 for use with the TSMs of the present invention is shown to include a hook structure 602 attached to a TSM 604 as shown in FIG. 6A and a corresponding peg 606 having an enlarged cap or head 608 attached to a leg 610 of a TLP structure (not shown) as shown in FIG. 6B. Looking at FIG. 6C, the locking system 600 is shown in an engaged state due to the TSM 604 being positively buoyant relative to the structure, which causing the hook structure 602 engage the peg 606. Thus, the TSM 604 can be positioned against the leg 610 and ballasted until the hook structures 602 are below the pegs 606 and adjusted so that the pegs 606 are centered within an opening 612 of the hook structure 602. Once properly positioned as shown in FIG. 6D, the TSM 604 can be deballasted until the pegs 606 fully engage the hooks 602. The TSM 604 can be removed by simply ballasting the TSM 604 until the pegs 606 are free of the hooks 602 as shown in FIG. 6D.

Although two preferred apparatus for securing and removing the TSMs of this invention to or from a structure have been described, it should be recognized that any temporary securing and attachment apparatus can be used as well including welding, bolts, hydraulically or manually operated piston types locks, pressure activated locks with manual, electrical or hydraulic releases, magnetic couplings, or any other detactable, locking or securing apparatus well known in the art.

TSM Stabilization During Transportation and Installation

Figure 7A:
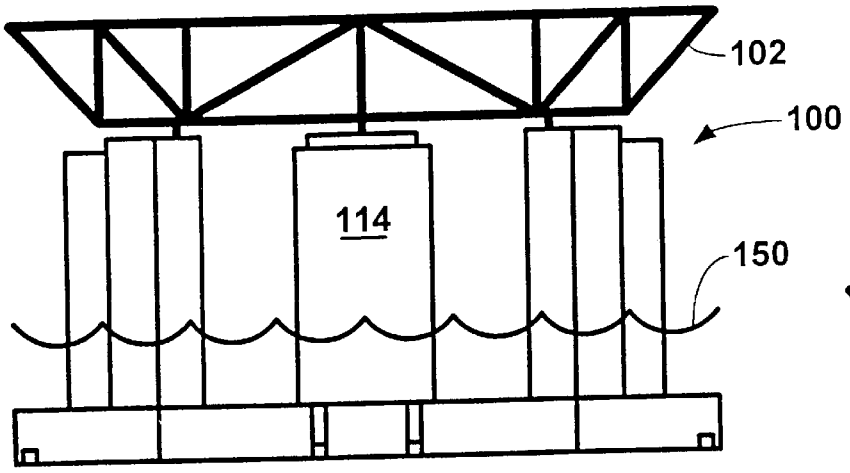
FIGS. 7A–C depict side views of a TLP including TSMs of this invention in a shallow draft before tendon attachment, at a deep or installation draft during tendon attachment and a stable draft after tendon attachment and tensioning, respectively.
Figure 7B:
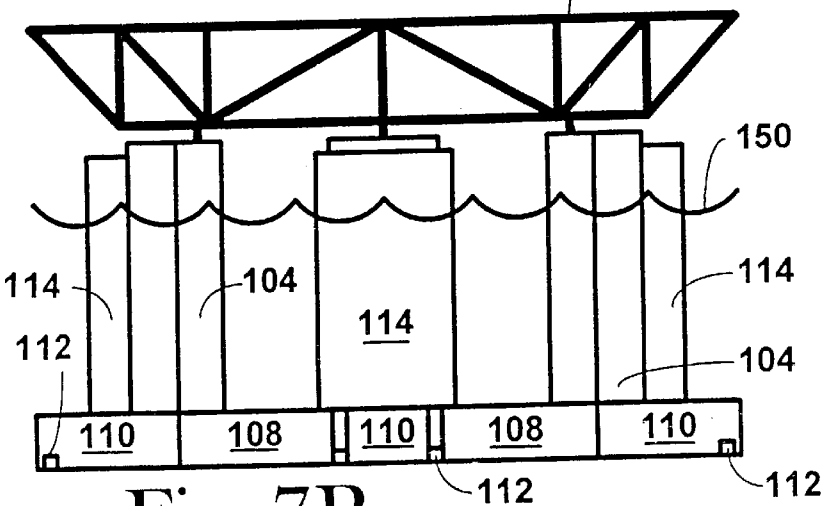
Figure 7C:
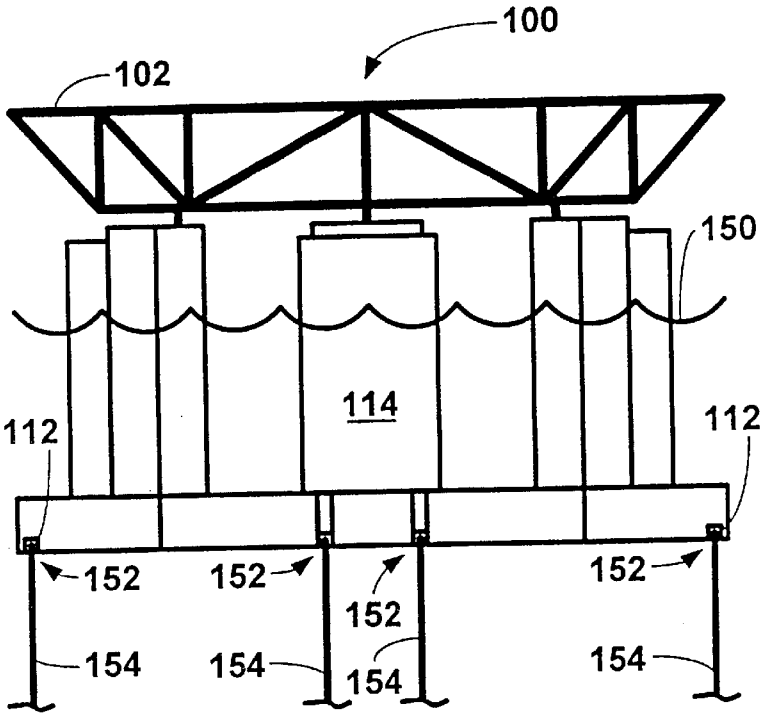
Figure 1A:
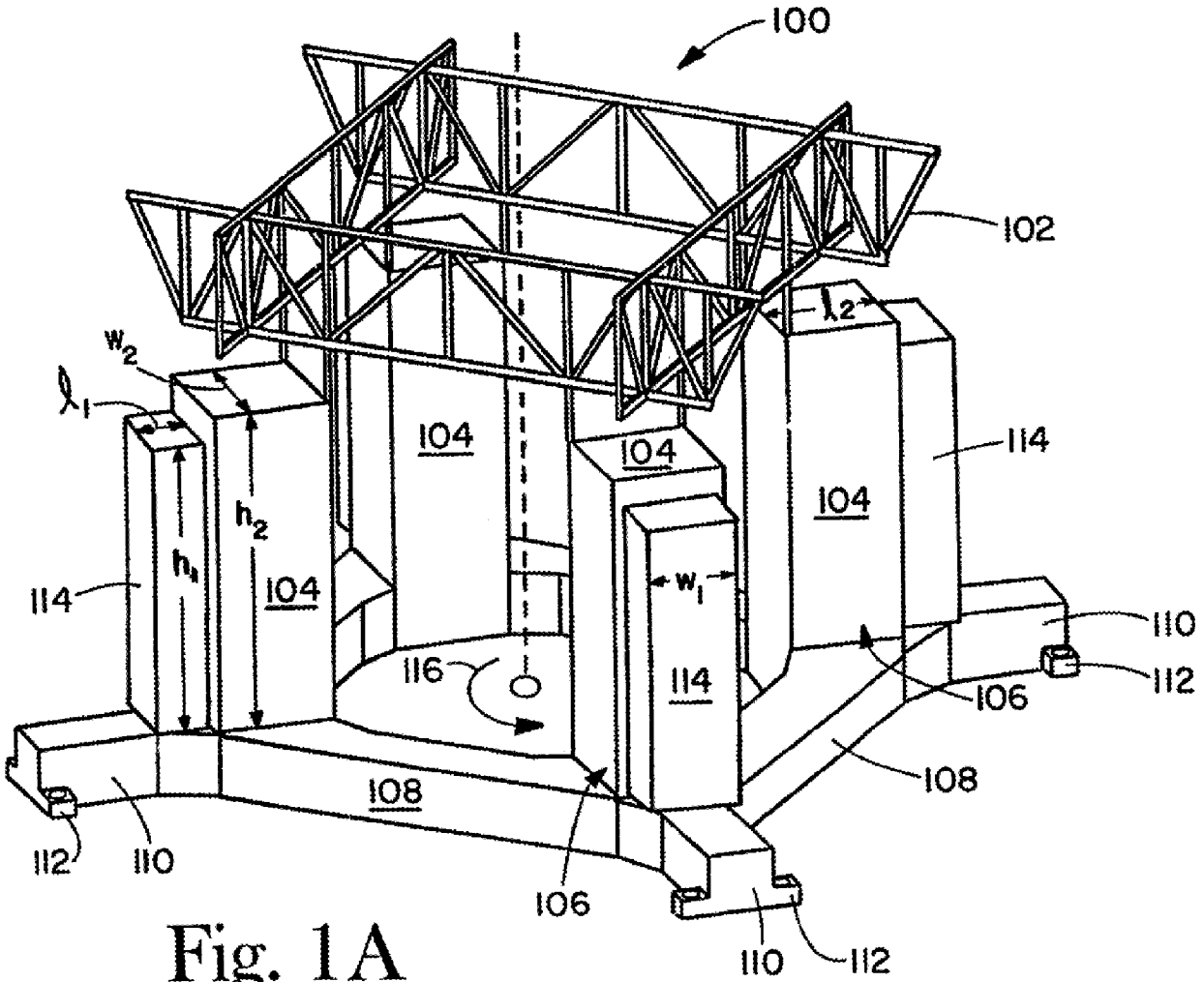

Referring now to FIGS. 7A&B, the structure 100 of FIG. 1A is shown in a state of relatively shallow draft in relation to a water line 150 in FIG. 7A; while the structure 100 is shown after being ballasted, lowering the structure 100 relative to the water line 150 to a draft suitable for installation. Looking now at FIG. 7C, the structure 100 is shown at its installation draft after distal ends 152 of tendons 154 have been attached to the structure 100 at the tendon attachments 112, where proximal ends of the tendons (not shown) are attached to the floor of the body of water in which the structure is being installed.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method for installing an offshore structure comprising the steps of:

attaching one or a plurality of temporary stabilization modules to a structure in a body of water at a first draft to form a stabilized structure;

transporting the stabilized structure from a first site to a second site, where at least a portion of each of the modules extends above a waterline and the modules increase a stability of the structure sufficient to maintain the structure in a substantially upright orientation during transporting;

ballasting the modules and/or the structure to change the first draft to a lower, installation draft, where a part of the portion of each of the modules remains above the waterline;

attaching a plurality of tendons to the structure;

deballasting the structure and/or the modules to tension the structure so that the structure can assume its installed draft; and removing the modules from the structure.

2. The method of claim 1, wherein the structure comprises a tension leg platform, an extended-base tension leg platform or a single column floater platform.

3. The method of claim 1, wherein the structure comprises a tension leg platform or an extended-base tension leg platform and where the platform includes at least three columns and at least two pontoons interconnected at least two adjacent columns and the platform includes an open central area.

4. A method for transporting a stabilized offshore structure comprising the steps of:

attaching one or a plurality of temporary stabilization modules to a structure in a body of water at an tensioned draft moored to a bottom of the body of water by a plurality of tendons, where at least a portion of each of the modules extends above a waterline and the modules increase a stability of the structure sufficient to maintain the structure in a substantially upright orientation;

ballasting the modules and/or the structure to change the draft of the structure from its tensioned draft to a lower, tendon detachment draft, where a part of the portion of each of the modules remains above the waterline;

deattaching the tendons from the structure;

deballasting the structure and/or the modules to a transportation draft;

transporting the structure with the modules, which are designed to maintain the structure in its substantially upright orientation, to a new site; and removing the modules from the structure.

5. The method of claim 1, wherein the structure comprises a tension leg platform, an extended-base tension leg platform or a single column floater platform.

6. The method of claim 1, wherein the structure comprises a tension leg platform or an extended-base tension leg platform and where the platform includes at least three columns and at least two pontoons interconnected at least two adjacent columns and the platform includes an open central area.

7. A method for transporting an offshore structure comprising the steps of:

attaching one or a plurality of temporary stabilization modules to a structure in a body of water at a first draft to form a stabilized structure;

transporting the stabilized structure from a first site to a second site;

installing a plurality of tendons to the structure to form a tensioned structure; and removing the modules from the tensioned structure, where at least a portion of each of the modules extends above a waterline and the modules are designed to increase a stability of the structure sufficient to maintain the structure in a substantially upright orientation during transporting and tendon installation.

8. The method of claim 7, wherein the structure comprises a tension leg platform, an extended-base tension leg platform or a single column floater platform.

9. The method of claim 7, wherein the structure comprises a tension leg platform or an extended-base tension leg platform and where the platform includes at least three columns and at least two pontoons interconnected at least two adjacent columns and the platform includes an open central area.

10. A method for transporting an offshore structure comprising the steps of:

attaching a plurality of temporary stabilization modules to a structure in a body of water at a first draft to form a stabilized structure;

transporting the stabilized structure from a first site to a second site;

installing a plurality of tendons to the structure to form a tensioned structure; and removing the modules from the tensioned structure, where at least a portion of each of the modules extends above a waterline during the transporting and installing steps and the modules are designed to increase a stability of the structure sufficient to maintain the structure in a substantially upright orientation during transporting and tendon installation.

11. The method of claim 10, wherein the structure comprises a tension leg platform, an extended-base tension leg platform or a single column floater platform.

12. The method of claim 11, wherein the platform includes at least three columns and at least two pontoons interconnected at least two adjacent columns and the platform includes an open central area.

13. The method of claim 10, wherein the structure comprises a tension leg platform or an extended-base tension leg platform and where the platform includes at least three columns and at least two pontoons interconnected at least two adjacent columns and the platform includes an open central area.

14. A method for transporting an offshore tension leg platform or extended-base tension leg platform comprising the steps of:

attaching one or a plurality of temporary stabilization modules to the platform in a body of water at a first draft to form a stabilized platform;

transporting the stabilized platform from a first site to a second site;

installing a plurality of tendons to the structure to form a tensioned structure; and removing the modules from the tensioned structure, where at least a portion of each of the modules extends above a waterline during the transporting and installing steps and where the modules are designed to increase a stability of the platform sufficient to maintain the platform in a substantially upright orientation during transporting and tendon installation.

* * * * *

UNITED STATES PATENT AND TRADEMARK OFFICE

CERTIFICATE OF CORRECTION

PATENT NO. : 6,503,023 B2
APPLICATION NO. : 09/853255
DATED : January 7, 2003
INVENTOR(S) : Huang et al.

It is certified that error appears in the above-identified patent and that said Letters Patent is hereby corrected as shown below:

In Fig. 1A on sheet 1 of 11 of the drawings, and on title page p1ease replace the indicator "$h_2$" associated with temporary stability module (TSM) 114 with --$h_1$--. (see attached)

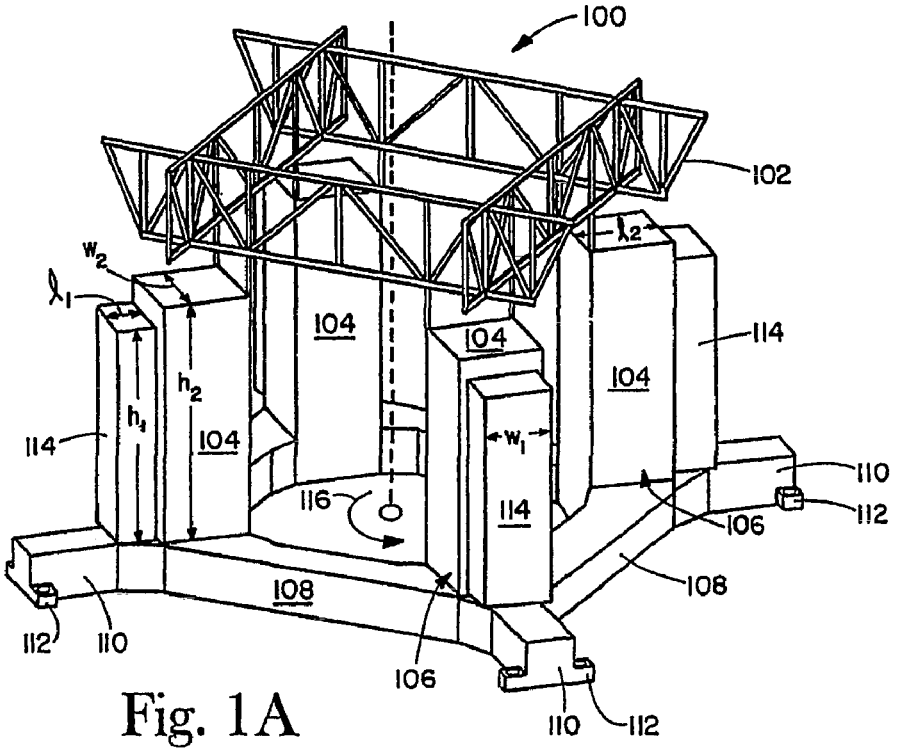

Fig. 1A

Signed and Sealed this

Twenty-eighth Day of November, 2006

JON W. DUDAS
*Director of the United States Patent and Trademark Office*

(12) United States Patent
Huang et al.

(10) Patent No.: US 6,503,023 B2
(45) Date of Patent: Jan. 7, 2003

(54) TEMPORARY FLOATATION STABILIZATION DEVICE AND METHOD

(75) Inventors: Edward Huang, Houston, TX (US); Bruce Zurbuchen, Katy, TX (US); Vince Giorgi, Houston, TX (US); Shaji Samuel, Houston, TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

(21) Appl. No.: 09/853,255

(22) Filed: May 11, 2001

(65) Prior Publication Data

US 2002/0025229 A1 Feb. 28, 2002

Related U.S. Application Data

(60) Provisional application No. 60/203,628, filed on May 12, 2000.

(51) Int. Cl.[7] ..... B63B 35/44; E02D 23/02

(52) U.S. Cl. ..... 405/206; 405/205; 405/223.1; 405/224; 114/264; 114/266

(58) Field of Search ..... 405/203, 204, 405/205–209, 223.1, 198, 199, 224; 114/259, 260, 264–267

(56) References Cited

U.S. PATENT DOCUMENTS

| | | | | | |
|---|---|---|---|---|---|
| 2,525,955 | A | * | 10/1950 | Scott | 405/205 |
| 2,938,352 | A | * | 5/1960 | Knapp et al. | 405/207 |
| 3,054,367 | A | * | 9/1962 | Alcorn et al. | 405/209 |
| 3,064,437 | A | * | 11/1962 | Knapp | 405/206 |
| 3,347,052 | A | * | 10/1967 | Steltle et al. | 405/205 |
| 3,610,193 | A | * | 10/1971 | Lacy | 114/265 |
| 3,633,369 | A | * | 1/1972 | Lawrence | 405/205 |
| 3,686,886 | A | | 8/1972 | Georgii | 61/46.5 |
| 3,780,685 | A | * | 12/1973 | Horton | 114/265 |
| 3,811,681 | A | | 5/1974 | Sprouse et al. | 273/139 |
| 3,823,564 | A | | 7/1974 | Crout et al. | 61/46.5 |
| 3,837,309 | A | * | 9/1974 | Biewer | 114/265 |
| 3,859,804 | A | | 1/1975 | Koehler et al. | 61/46.5 |
| 3,919,957 | A | * | 11/1975 | Ray et al. | 114/265 |
| 4,062,313 | A | | 12/1977 | Stram | 114/265 |
| 4,112,697 | A | | 9/1978 | Chow | 405/209 |
| 4,270,877 | A | * | 6/1981 | Post | 405/198 |
| 4,385,578 | A | | 5/1983 | Grace | 114/77 A |
| 4,456,402 | A | * | 6/1984 | Boon | 405/206 X |
| 4,511,287 | A | | 4/1985 | Horton | 405/204 |
| 4,547,095 | A | | 10/1985 | Macchi et al. | 405/206 |
| 4,648,751 | A | | 3/1987 | Coleman | 405/209 |
| 4,662,302 | A | * | 5/1987 | Molnes | 114/265 |
| 4,768,456 | A | | 9/1988 | Jones et al. | 114/266 |
| 4,809,636 | A | | 3/1989 | Robishaw et al. | 114/267 |
| 4,811,681 | A | | 3/1989 | Robishaw et al. | 114/267 |
| 4,874,269 | A | | 10/1989 | Dysarz | 405/209 |
| 4,913,591 | A | | 4/1990 | Steele | 405/196 |
| 5,111,764 | A | * | 5/1992 | D'Ettorre | 114/259 |
| 5,224,962 | A | | 7/1993 | Kazal et al. | 405/204 |
| 5,403,124 | A | | 4/1995 | Kocaman et al. | 405/209 |
| 5,525,011 | A | | 6/1996 | Huang | 405/223.1 |

(List continued on next page.)

FOREIGN PATENT DOCUMENTS

| | | | | |
|---|---|---|---|---|
| EP | 97069 | * | 12/1983 | 405/206 |

OTHER PUBLICATIONS

Unknown(Figure 6.8.1)–Temporary Buoyancy Augmentation (undated).

*Primary Examiner*—Jong-Suk (James) Lee
(74) *Attorney, Agent, or Firm*—Robert W. Strozier; Alan H. Gordon

(57) ABSTRACT

A temporary stability module and method for marine structures during construction, transportation and installation is taught. The device and method permit the structure, including platforms, deck and equipment to be constructed in an upright position, towed to an ocean installation site, and installed by ballasting the structure or temporary stability module and subsequent removal of the module.

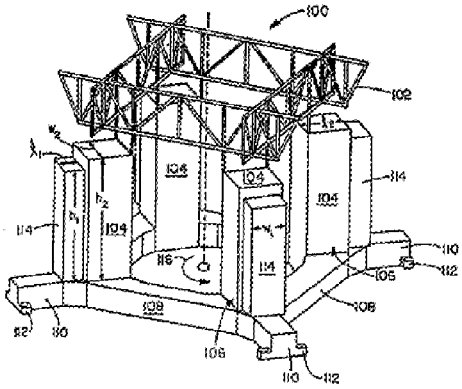

14 Claims, 11 Drawing Sheets